US006983116B2

(12) United States Patent
Maetani

(10) Patent No.: US 6,983,116 B2
(45) Date of Patent: Jan. 3, 2006

(54) IMAGE FORMING APPARATUS HAVING A HORIZONTAL OPTICAL PATH

(75) Inventor: Masami Maetani, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/457,386

(22) Filed: Jun. 10, 2003

(65) Prior Publication Data

US 2003/0235433 A1 Dec. 25, 2003

(30) Foreign Application Priority Data

Jun. 25, 2002 (JP) ..... 2002-185256

(51) Int. Cl.
*G03G 15/08* (2006.01)

(52) U.S. Cl. ..... 399/252; 399/258; 399/262; 399/263

(58) Field of Classification Search ..... 399/107, 399/119, 258, 262, 318, 120, 252, 255, 256, 399/260, 263; 358/505
See application file for complete search history.

(56) References Cited

U.S. PATENT DOCUMENTS 5,450,180 A * 9/1995 Ohzeki et al. ..... 399/50
5,839,032 A 11/1998 Yasui et al. ..... 399/124
6,256,469 B1 * 7/2001 Taniyama et al. ..... 399/258
6,334,037 B1 * 12/2001 Ise ..... 399/262

* cited by examiner

*Primary Examiner*—Hoang Ngo
(74) *Attorney, Agent, or Firm*—Fitzpatrick, Cella, Harper & Scinto

(57) ABSTRACT

In an image forming apparatus, a transporting path of a recording medium is provided in a direction extending from a lower region to a higher region. Furthermore, in order to allow a toner to be supplied from a toner supplying container to a developing device, an optical path of an image-exposure light from an exposing device to a photoreceptor is provided substantially in a horizontal direction, and the developing device is disposed below the optical path while the toner supplying container is disposed above the optical path. The image forming apparatus has a simple construction, and can be implemented at a relatively low cost and in a small size.

5 Claims, 5 Drawing Sheets

IMAGE FORMING APPARATUS HAVING A HORIZONTAL OPTICAL PATH

BACKGROUND OF THE INVENTION

1. Field of the Invention

The present invention generally relates to electrophotographic image forming apparatuses, and particularly to an image forming apparatus such as a copying machine, a printer, or a facsimile machine.

2. Description of the Related Art

In order to reduce sizes of apparatuses and to improve operability, as a type of process cartridge in which a photosensitive drum, a charger, a developing device, etc. are integrated, an image forming apparatus in which an optical path for an image-exposure light from an exposing device to the photosensitive drum is provided in a substantially horizontal direction, and in which a fixing device is disposed above the photosensitive drum, has been proposed.

In the conventional image forming apparatus, the developing device for attaching a toner to an electrostatic latent image formed on the photosensitive drum to form a visible toner image is urged toward the photosensitive drum by an urging member so that a developing sleeve of the developing device is abutted on the photosensitive drum.

In the conventional image forming apparatus employing the process-cartridge arrangement described above, in which the optical path for the image-exposure light from the exposing device to the photosensitive drum is disposed horizontally, it has been difficult to allow a large amount of toner to be contained in a developer container in the developing device since a space for the optical path for image exposure is provided between the charger and the developing device in the process cartridge.

U.S. Pat. No. 5,839,032 discloses an arrangement in which a path for transporting a recording medium is provided in a direction extending from a lower position to an upper position and in which a developing device is disposed below a laser exposing device while a toner supplying container is disposed above the laser exposing device. In the image forming apparatus, two mirrors are used so that a laser beam from a polygon mirror in the laser exposing device will be incident diagonally on a photoreceptor.

However, in the image forming apparatus disclosed in U.S. Pat. No. 5,839,032, the two mirrors for reflecting the laser beam from the polygon mirror are needed in the laser exposing device. Thus, the number of parts constituting the laser exposing device is large and the cost is high. Furthermore, since the arrangement is such that the light from the laser exposing device is incident diagonally on the photoreceptor, a part of the case of the laser exposing device projects upward, increasing the size of the laser exposing device in the vertical direction. This has been a factor that inhibits reduction in the sizes of image forming apparatuses.

SUMMARY OF THE INVENTION

Accordingly, it is an object of the present invention to provide an image forming apparatus in which a transporting path of a recording medium extends in a direction from a lower position to an upper position and in which an arrangement for supplying a toner from a toner supplying container to a developing device is chosen so that the image forming apparatus can be implemented in a small size without employing a complex structure.

To this end, the present invention, in one aspect thereof, provides an image forming apparatus including an image bearing member; an exposing unit disposed on a side of the image bearing member, for performing an image exposure on the image bearing member; a developing unit for developing, with a toner, an electrostatic image formed on the image bearing member; a toner supplying container for supplying the toner to the developing unit, the toner supplying container being detachable from a main body of the image forming apparatus; and a transporting unit for transporting, from a lower position to an upper position, a recording medium onto which a toner image is to be transferred from the image bearing member; wherein an optical path extending from the exposing unit to the image bearing member is substantially horizontal, and the developing unit is disposed below the optical path while the toner supplying container is disposed above the optical path.

Further objects, features and advantages of the present invention will become apparent from the following description of the preferred embodiments with reference to the attached drawings.

DESCRIPTION OF THE PREFERRED EMBODIMENTS

Now, an embodiment of the present invention will be described with reference to the drawings.

Figure 1:
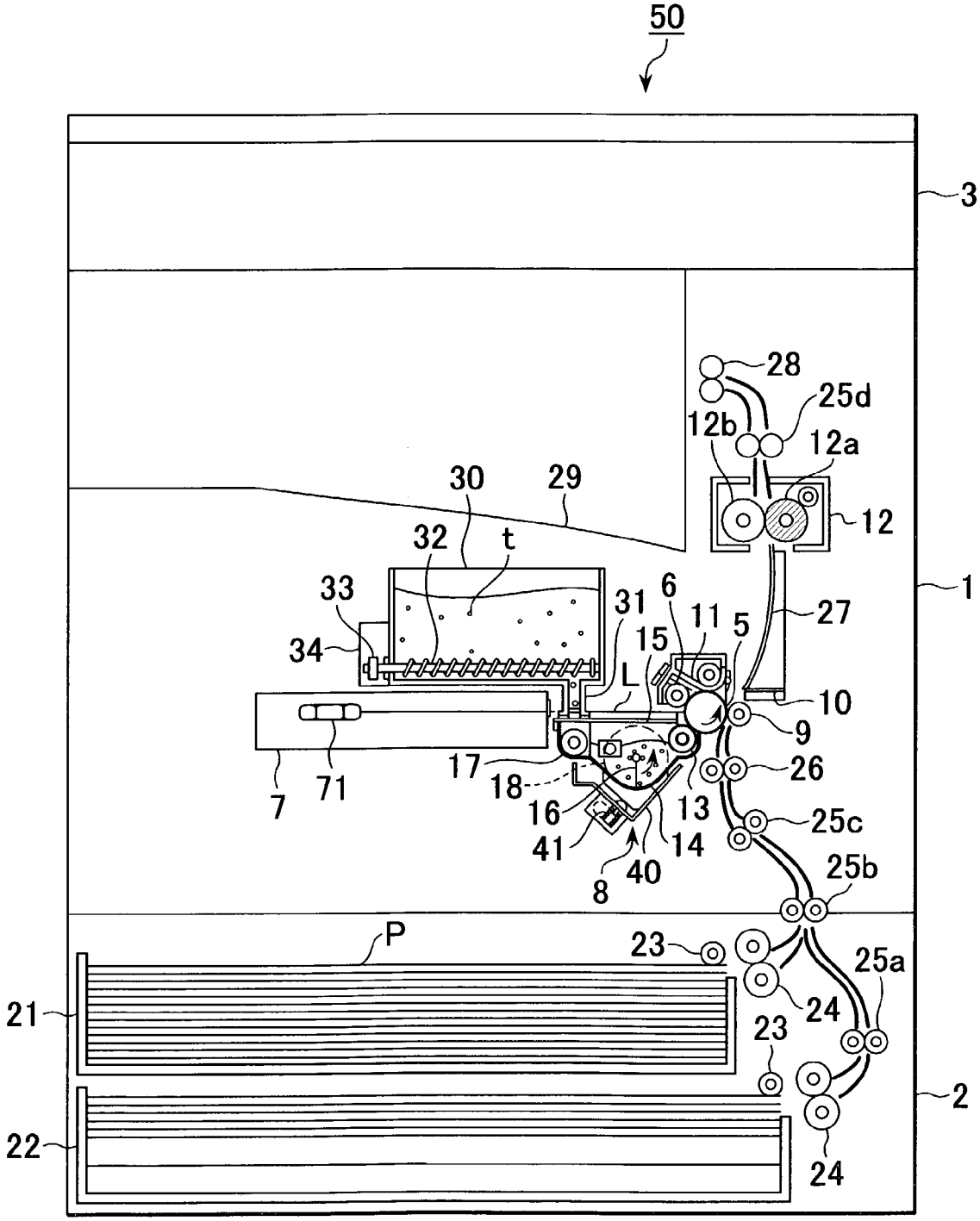
FIG. 1 is a schematic sectional view of an image forming apparatus according to an embodiment of the present invention, in a state where a developing sleeve of a developing device is urged toward a photosensitive drum.

FIG. 1 is a schematic diagram showing the construction of an image forming apparatus according to an embodiment of the present invention (a multi-function machine having functions of an electrophotographic copying machine, a printer, and a facsimile machine in this embodiment). In FIG. 1, the front side of the image forming apparatus 50 is in the direction out of the sheet, and the back side thereof is in the direction into the sheet. The image forming apparatus 50 includes an image forming unit (printer unit) 1 for forming a toner image, a recording-medium transporting unit 2 for containing recording media P, such as sheets of paper, and feeding them one by one to the image forming unit 1, and a reader scanner unit 3 for reading an image of an original document.

The image forming unit 1 includes a drum-shaped electrophotographic photoreceptor (hereinafter referred to as a photosensitive drum) 5 that serves as an image bearing member. The image forming unit 1 also includes a charging roller 6, an exposing device 7, a developing device 8, a transferring roller 9, a detaching charger 10, a cleaning blade, etc. that are disposed in the circumference of the photosensitive drum 5. The image forming unit 1 also includes a fixing device 12 that is disposed above the photosensitive drum 5, at a downstream of a transferring nip region between the photosensitive drum 5 and the transfer roller 9 in the direction of transportation of recording media.

The photosensitive drum 5 in this embodiment is an organic photosensitive drum that is to be charged negatively, having a photosensitive layer of an organic photoconductor (OPC) on a drum base composed of aluminum. The photosensitive drum 5 is driven by a driving device (not shown) so as to rotate in the direction of an arrow (counterclockwise) at a predetermined rotation rate (processing speed), and it gets negatively charged uniformly by the charging roller 6 coming in contact therewith during the rotation.

The charging roller 6 is abutted on the surface of the photosensitive drum 5 by a predetermined pressure so as to rotate in association with the photosensitive drum 5. The charging roller 6 charges the photosensitive drum 5 uniformly to a predetermined potential of a predetermined polarity by a charging bias applied by a charging-bias power source (not shown).

The exposing device 7, by a laser emitting unit thereof (not shown), outputs a laser beam (exposing beam) modulated in accordance with a time-series electric digital image signal, of image information that is input, for example, from the reader scanner unit 3, and carries out an image exposure (scanning exposure) on the surface of the charged photosensitive drum 5, whereby an electrostatic latent image corresponding to the image information is formed. The exposing device 7 in this embodiment is arranged so as to carry out an image exposure on the surface of the photosensitive drum 5 with an optical path of an image-exposure light L substantially horizontal with respect to the photosensitive drum 5.

The developing device 8 includes a rotatable developing sleeve 13 that is abutted on the surface of the photosensitive drum 5. The developing device 8 attaches a toner on the electrostatic latent image on the photosensitive drum 5 in a developing region, thereby forming a visible toner image. The developing device 8 in this embodiment is disposed below the optical path of the image-exposure light L with which the exposing device 7 irradiates the surface of the photosensitive drum 5. The developing device 8, which constitutes a feature of the present invention, will be described later in more detail.

The transferring roller 9 is in contact with the surface of the photosensitive drum 5 by a predetermined pressure, whereby a transferring nip region is formed. The transferring roller 9, by a transferring bias applied by a transferring-bias power source (not shown), transfers the toner image on the surface of the photosensitive drum 5 onto a recording medium P, such as a sheet of paper, transported by the recording-medium transporting unit 2, in the transferring nip region between the photosensitive drum 5 and the transferring roller 9.

The cleaning blade 11 removes and collects residual toner remaining on the surface of the photosensitive drum 5 after the transferring operation.

The fixing device 12 includes a heating roller 12*b* including a halogen heater (not shown), and also includes a pressure roller 12*a*. The fixing device 12 applies a heat and a pressure to thermally fix the toner image transferred onto the surface of the recording medium P while holding and transporting the recording medium P at a fixing nip region between the heating roller 12*b* and the pressure roller 12*a*.

Next, an image forming operation that is executed by the image forming apparatus 50 described above will be described.

First, in the reader scanner unit 3, with an original document that is set (not shown), a scanning exposure is carried out by an exposing lamp (not shown), and a light reflected from the original document (reflected-light image) is focused on a CCD (not shown) through a plurality of mirrors (not shown) and condenser lenses (not shown) to yield an image signal. The image signal is converted into a time-series electric digital pixel signal, which is forwarded to the exposing device 7 of the image forming unit 1.

In the image forming unit 1, the photosensitive drum 5 is driven by a driving device (not shown) to rotate at a predetermined rate in the direction of an arrow (counterclockwise), and is uniformly charged to a predetermined negative potential by the charging roller 6 with a charging bias applied thereto. The exposing device 7 modulates the time-series electric digital pixel signal input thereto, and irradiates the surface of the charged photosensitive drum 5 with an image-exposure light L composed of a modulated laser beam from a horizontal direction, thereby forming an electrostatic latent image corresponding to the original-document image.

The exposing device 7 includes a laser emitting unit, and a polygon mirror 71 for irradiating and scanning the photosensitive drum 5 with a laser beam emitted by the laser emitting unit. An image-exposure light L from the polygon mirror 71 is incident on the photosensitive drum 5 substantially horizontally without being reflected by a mirror or the like in the middle.

As described above, the exposing device 7 is disposed substantially horizontally in the image forming apparatus 50, and the image-exposure light L is incident on the photosensitive drum 5 through an optical path in the horizontal direction. Accordingly, the exposing device 7 can be implemented at a relatively low cost, and the size of the image forming apparatus 50 in the vertical direction can be minimized.

Then, the developing sleeve 13 of the developing device 8, with a developing bias having the same polarity as the charging polarity of the photosensitive drum 5 (negative) applied thereto, attaches a toner to the electrostatic latent image formed on the photosensitive drum 5 in the developing region where the developing sleeve 13 is abutted on the photosensitive drum 5, and a visible toner image is formed by a reversal development.

Recording media P, such as sheets of paper, in cassettes 21 and 22 in the recording-media transporting unit 2, which serve as recording-media containing units, are fed one by one by a pickup roller 23, and transported to a resist-roller pair 26 by a transportation separating roller 24 and a plurality of transporting rollers 25*a*, 25*b*, and 25*c* in synchronization with the formation of toner image on the photosensitive drum 5. Then, when the toner image on the photosensitive drum 5 reaches the transferring nip region between the photosensitive drum 5 and the transferring roller 9, in synchronization with that timing, a recording medium P transported upward from one of the cassettes 21 and 22 disposed below is fed to the transferring nip region by the resist-roller pair 26.

Then, the transferring roller 9, with a transferring bias applied thereto having the opposite polarity (positive) of the polarity of the toner, transfers the toner image on the photosensitive drum 5 onto the recording medium P transported to the transferring nip region, by an electrostatic force generated between the photosensitive drum 5 and the transferring roller 9. The recording medium P is then transported upward toward the fixing nip region. The recording medium P with the toner image having been transferred thereto is detached from the photosensitive drum 5 by the detaching charger 10, and transported to the fixing device 12 through a transporting guide 27. Then, the toner image is thermally fixed on the recording medium P by applying a heat and a pressure in the fixing nip region between the heating roller 12*b* and the pressure roller 12*a* of the fixing device 12. The recording medium P with the toner image having been fixed thereon is ejected by a transporting roller 25*d* and an ejecting roller 28, and piled in an ejecting unit 29 disposed between the image forming unit 1 including the photosensitive drum 5 and the reader scanner unit 3, i.e., what is called an inner tray. An image is formed by the image forming operation having the series of steps described above.

As described above, the transportation path of the recording medium P from the cassettes 21 and 22 to the ejecting unit 29 through the transferring section and the fixing section extends in a direction from low to high (a direction that is substantially opposite to the direction of gravity). This simplifies and shortens the transporting path of the recording medium P.

Toner remaining on the photosensitive drum 5 after the transferring operation is removed and collected by the cleaning blade 11.

The image forming apparatus 50 according to this embodiment is capable of functioning as a printer by receiving input of image data, text data, etc., for example, from a computer that is not shown and irradiating the photosensitive drum 5 with a laser beam in accordance with the input data by the exposing device 7. Furthermore, the image forming apparatus 50 is capable of functioning as a facsimile machine by receiving input of facsimile image data from another terminal that is not shown via a telephone circuit or the like and irradiating the photosensitive drum 5 with a laser beam in accordance with the data by the exposing device 7.

Next, the developing device 8 in this embodiment will be described in detail.

The developing device 8 in this embodiment includes the developing sleeve 13 disposed at an opening of the developer container 14, a fixed magnetic roller (not shown) that is fixed in the developing sleeve 13, a thickness regulating blade 15 for regulating the thickness of a layer of a developer (toner) with which the surface of the developing sleeve 13 is coated, a stirring paddle 16 for stirring the developer and transporting the developer toward the developing sleeve 13, a toner transporting screw 17 for transporting a toner t supplied from a toner supplying container 30 through a supplier opening 31 to the side of the stirring paddle 16 in the developer container 14, and a toner detecting sensor 18 for detecting the amount of toner in the developer container 14.

In the developer container 14 in this embodiment, the stirring paddle 16 is disposed in a central region and in a longitudinal direction thereof. In an upper region of the developer container 14, the developing sleeve 13 is disposed on the side of the photosensitive drum 5, and the toner transporting screw 17 is disposed on the opposite side of the developing sleeve 13 with respect to the stirring paddle 16. The rotational center of the stirring paddle 16 resides lower than the rotational centers of the developing sleeve 13 and the toner transporting screw 17, and the developing sleeve 13 and the toner transporting screw 17 reside substantially on the same horizontal plane.

A lower region of the developer container 14 has a shape of an arc that is somewhat smaller than the rotational radius of the stirring paddle 16. The developing sleeve 13, the stirring paddle 16, and the toner transporting screw 17 are disposed in parallel with each other along the longitudinal directions thereof.

The stirring paddle 16 has a flexible sheet. The stirring paddle 16 is rotated in the direction of an arrow (counterclockwise) between the developing sleeve 13 and the toner transporting screw 17 with a distal end of the flexible sheet in contact with an inner surface of the developer container 14, whereby the developer is stirred and transported to the side of the developing sleeve 13. At this time, part of the developer is drawn up by a drawing-up terminal (not shown) of the fixed magnetic roller (not shown) in the developing sleeve 13, and the developer that has been drawn up is attached to the surface of the developing sleeve 13, the thickness thereof being regulated within a predetermined thickness by the thickness regulating blade 15.

Then, by the rotation of the developing sleeve 13, the developer forming a layer of a regulated thickness on the surface of the developing sleeve 13 is transported to the proximity of the developing region opposing the photosensitive drum 5, and the electrostatic latent image on the photosensitive drum 5 is developed to form a visible image.

Figure 2:
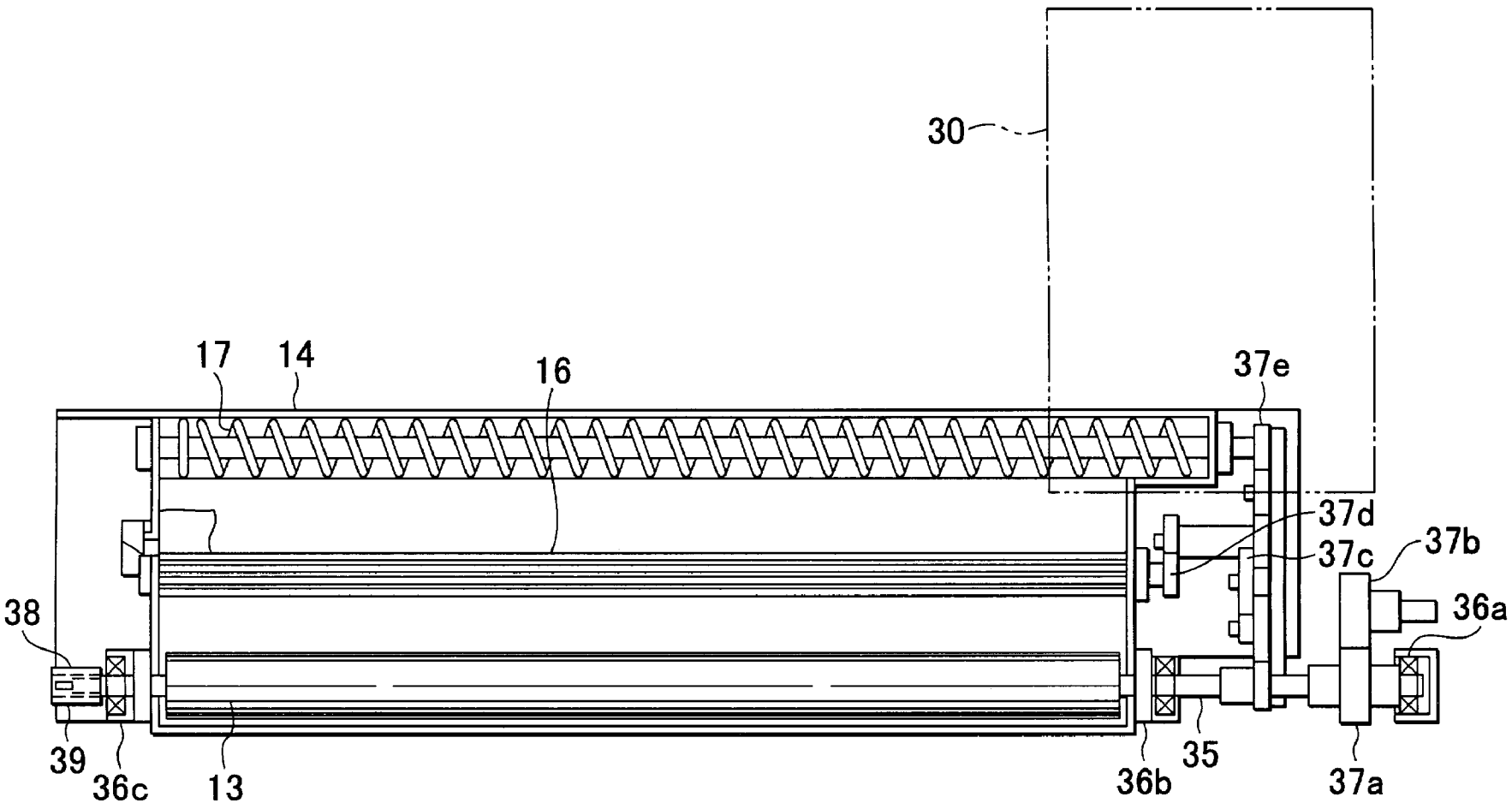
FIG. 2 is a schematic sectional view of the developing device in the embodiment.

Referring to FIG. 2, a rotational shaft 35 of the developing sleeve 13 is rotatably supported by bearings 36*a*, 36*b*, and 36*c*, and it is driven by a driving device (not shown) in the image forming unit 1, linked by gears 37*a* and 37*b*. The driving force of the driving device (not shown) is also transmitted to the stirring paddle 16 and the toner transporting screw 17 via the gear 37*b*, the gear 37*a*, a gear train 37*c*, a gear 37*d*, and a gear 37*e*, so that the stirring paddle 16 and the toner transporting screw 17 also rotate in association with the rotation of the developing sleeve 13.

Figure 3:
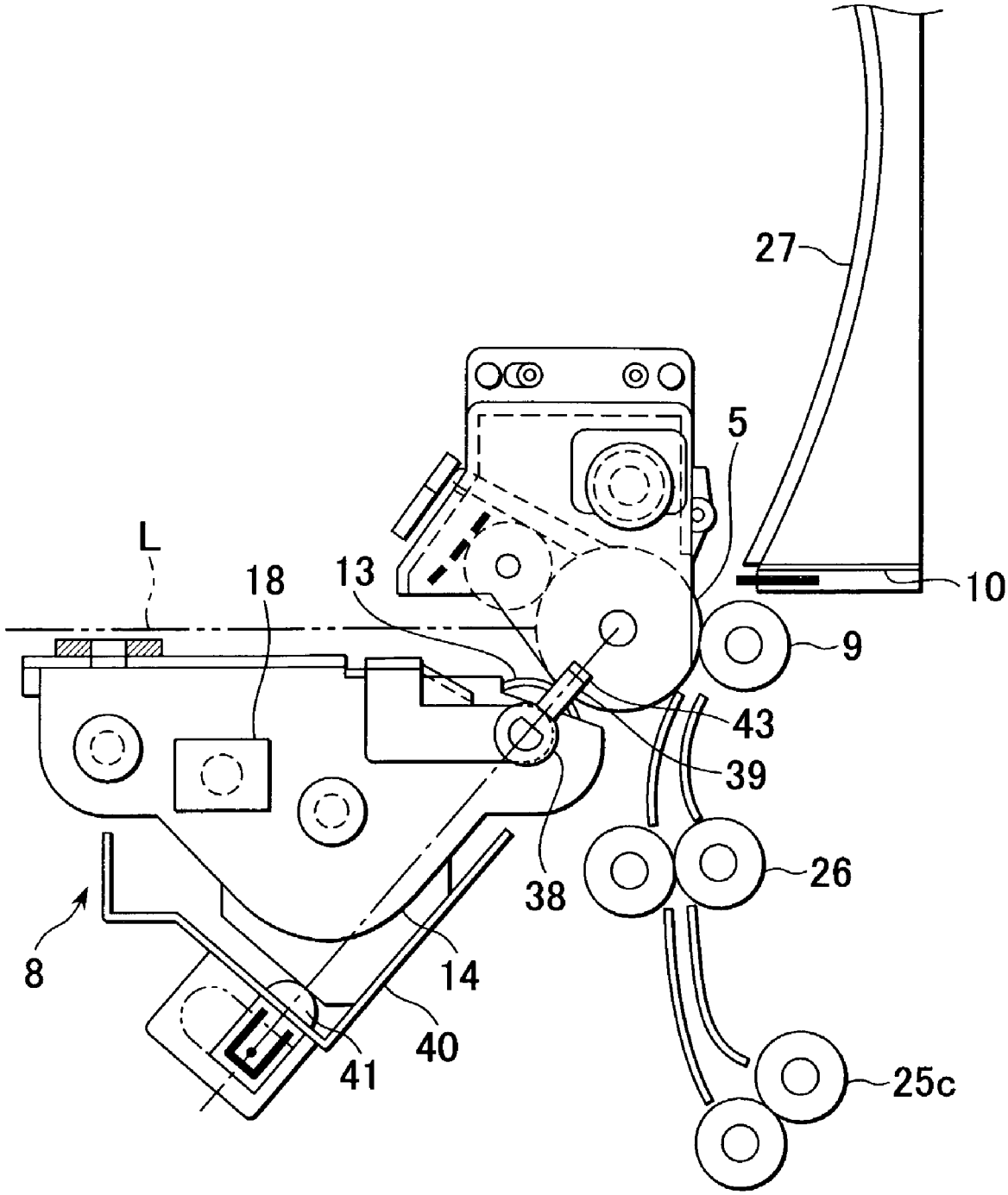
FIG. 3 is a schematic diagram showing a state where the developing device is urged toward the photosensitive drum in the embodiment.

Furthermore, as shown in FIGS. 2 and 3, at an edge of a roller shaft (not shown) that serves as a non-rotational shaft of the fixed magnetic roller (not shown) disposed in the developing sleeve 13, the edge being located on the front side (left as viewed in FIG. 2) of the image forming apparatus 50, a positioning member 38 having a cutout portion on the circumferential surface opposing the photosensitive drum 5 is attached. On the surface with the cutout portion of the positioning member 38, opposing the photosensitive drum 5, a positioning protrusion 39 is fixed so as to reside on a straight line connecting the rotational centers of the developing sleeve 13 and the photosensitive drum 5. Furthermore, on a drum unit (not shown) that supports the photosensitive drum 5 so as to allow rotation thereof, a guide member 43 having a groove for guiding the positioning protrusion 39 is provided in accordance with the direction of the positioning protrusion 39.

Furthermore, the developer container 14 in this embodiment is supported by a developer-container guide stay 40 that is movable with respect to the photosensitive drum 5. On a surface of the developer-container guide stay 40, residing on a line connecting the rotational centers of the developing sleeve 13 and the photosensitive drum 5, a cam 41 for urging the developing sleeve 13 toward the photosensitive drum 5 is disposed. The cam 41 is disposed along the longitudinal direction of the developer-container guide stay 40. Furthermore, as shown in FIG. 4, a spring 42 that functions as an urging member is provided in the cam 41, and the urging force of the spring 42 operates in the same direction as the direction of linear movement of the developer-container guide stay 40.

Figure 4:
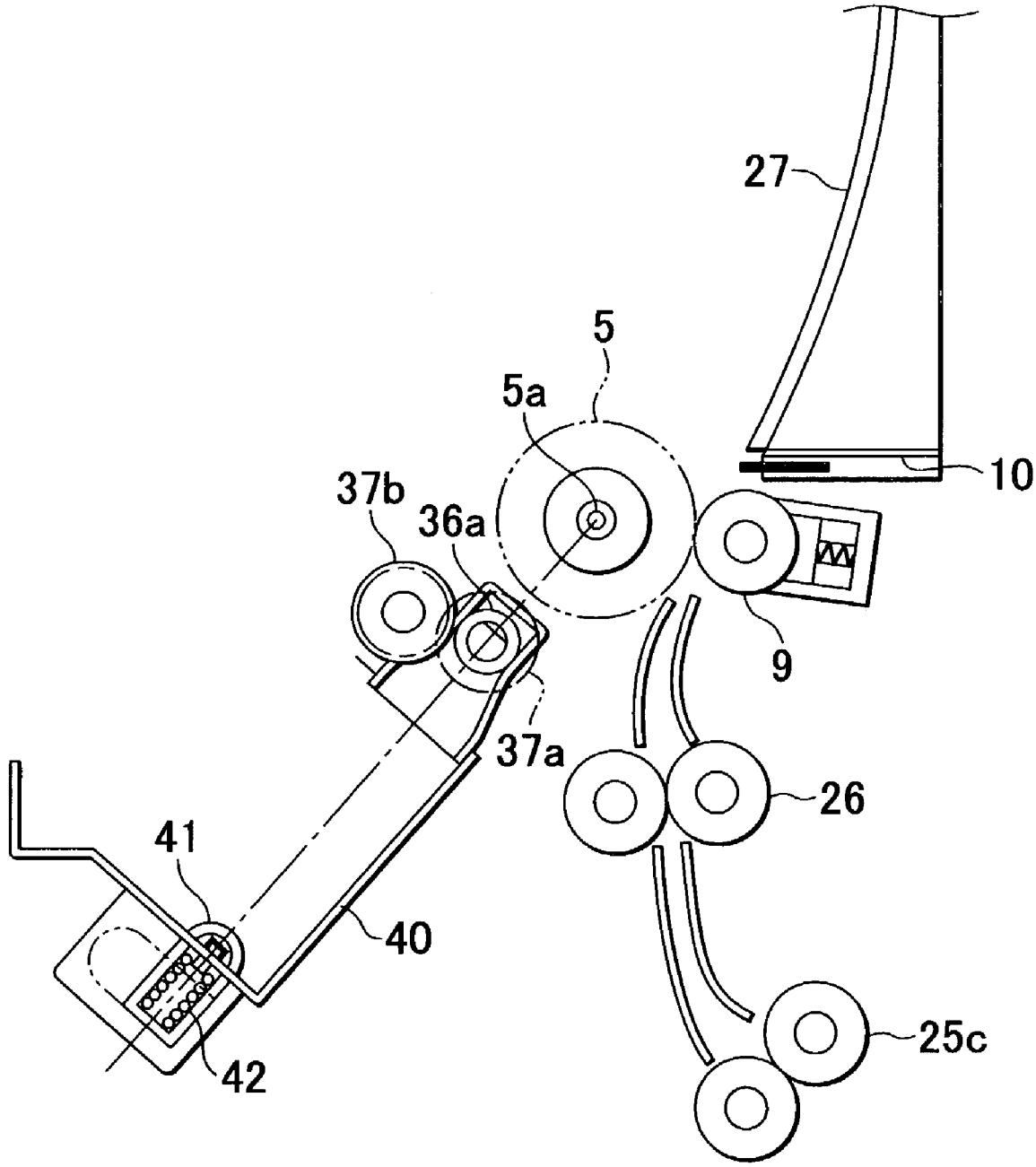
FIG. 4 is a schematic diagram showing a state where the developing device is urged toward the photosensitive drum in the embodiment.
Figure 5:
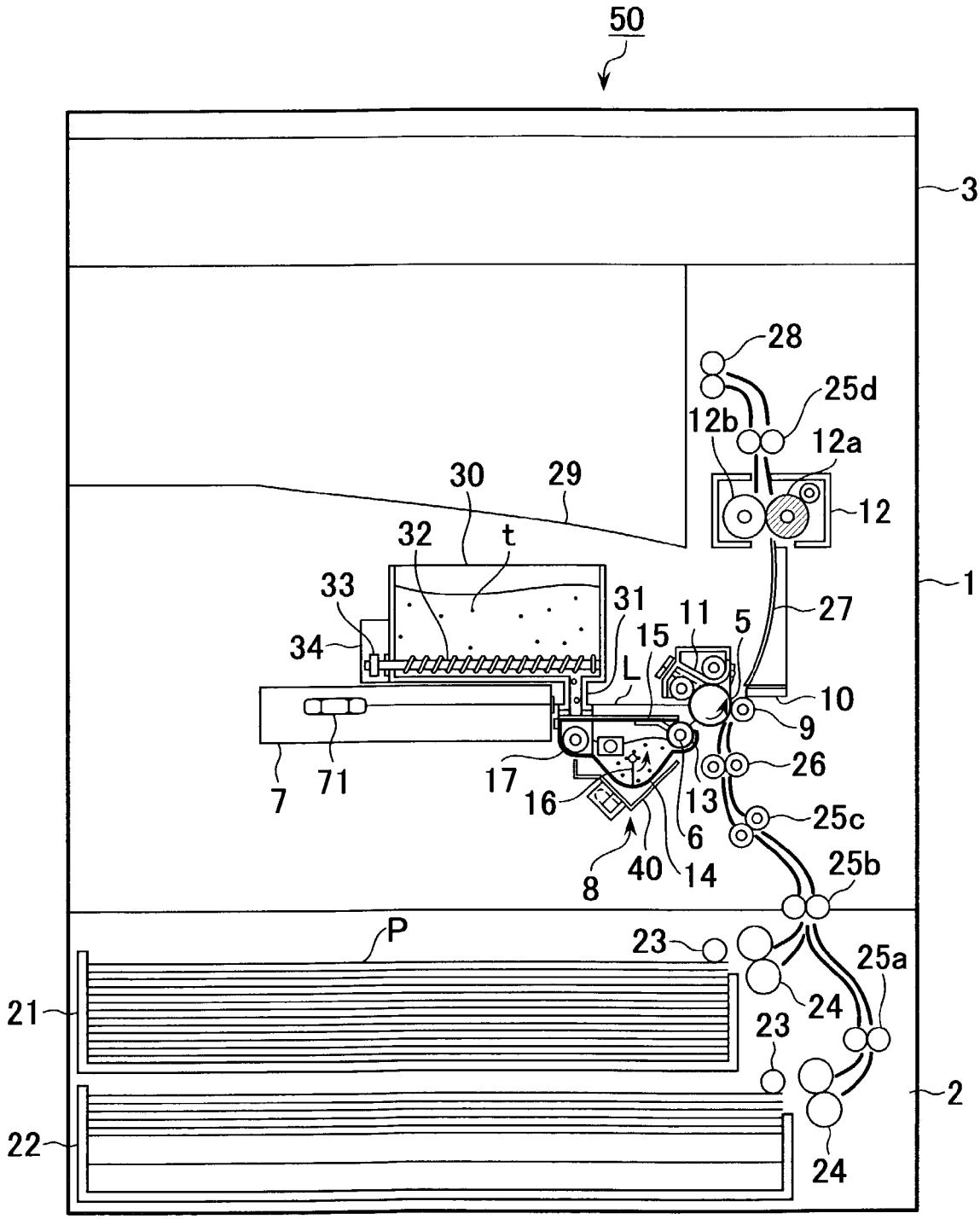
FIG. 5 is a schematic diagram showing the image forming apparatus according to the embodiment, in a state where the urging of the developing sleeve of the developing device toward the photosensitive drum is released.

Furthermore, in this embodiment, as shown in FIGS. 2 and 4, the line connecting the rotational centers of the bearing 36*a* for the rotational shaft 35 of the developing sleeve 13 and a rotational shaft 5*a* for the photosensitive drum 5, located at the back side of the image forming apparatus 50 (right as viewed in FIG. 2), is in the same direction as the direction of movement of the developer-container guide stay 40. Furthermore, in the drum unit (not shown) supporting the photosensitive drum 5 so as to allow rotation thereof, a guide member (not shown) for guiding the bearing 36*a* in accordance with the direction of movement of the bearing 36*a* of the rotational shaft 35 is provided.

The toner supplying container 30 is disposed above the optical path of the image-exposure light L and above the exposing device 7, and so as to overlap with the exposing device 7 and the developing device 8 at least partially. Furthermore, the toner supplying container 30 is connected to the developer container 14 through the supplier opening 31. Thus, a path for supplying the toner from the toner supplying container 30 to the developing device 8 is formed substantially along the direction of gravitation.

The toner t in the toner supplying container 30 is supplied to the developer container 14 through the supplier opening 31 having a shutter lid (not shown) by the rotation of a screw 32 (FIG. 1) disposed in a lower region of the toner supplying container 30. Since the toner supplying container 30 is disposed above the developer container 14 as described above, the toner can be transported and supplied by a gravitational force without adding members for transporting and supplying the toner between the toner supplying container 30 and the developer container 14.

The screw 32 is disposed so as to be substantially parallel with the optical path of the image-exposure light L with which the exposing device 7 irradiates the photosensitive drum 5 and perpendicular to the toner transporting screw 17. The screw 32 is driven and rotated by a driving device 34 that is linked thereto by a driving transmission gear 33. The driving device 34 is driven according to a control signal from a controller (not shown) when it is determined by the toner detecting sensor 18 that the concentration of toner in the developer container 14 has been reduced by developing operations, and an appropriate amount of toner t in accordance with the reduction of toner concentration is supplied to the developer container 14 through the supplier opening 31 by the rotation of the screw 32. The toner t supplied to the developer container 14 is transported into the developer in the developer container 14 by the rotation of the toner transporting screw 17. Thus, the amount of toner in the developer is maintained within a predetermined range.

The developing device 8 in this embodiment is constructed as described above. When the developing device 8 is not in an image forming operation (i.e., during maintenance), as shown in FIG. 4, a service person moves the cam 41 to a position such that it does not apply a pressure on the developer-container guide stay 40, and moves the developer container 14 on the developer-container guide stay 40 to the opposite side of the photosensitive drum 5 along the straight line connecting the rotational centers of the developing sleeve 13 and the photosensitive drum 5 by an urging force of the spring 42. Thus, during maintenance, the developing sleeve 13 is detached from the photosensitive drum 5.

When the maintenance is completed, the cam 41 is moved to apply a pressure on the developer-container guide stay 40. By the pressure applied on the developer-container guide stay 40 by the cam 41, the developer-container guide stay 40 is moved against the force of the spring 42. More specifically, at the longitudinal end of the developing sleeve 13 on the front side of the image forming apparatus 50, the developer-container guide stay 40 is moved linearly along the straight line connecting the rotational centers of the developing sleeve 13 and the photosensitive drum 5 with the positioning protrusion 39 being guided by the guide member 43, as shown in FIG. 3. At the longitudinal end of the developing sleeve on the back side of the image forming apparatus 50, the developing sleeve 13 is moved linearly along the straight line connecting the rotational centers of the bearing 36*a* for the rotational shaft 35 of the developing sleeve 13 and the rotational shaft 5*a* of the photosensitive drum 5 with the bearing 36*a* for the rotational shaft 35 being guided by a guide member (not shown).

The positioning protrusion 39 is stopped at a predetermined position in accordance with a stop position of the guide member 43, and the bearing 36*a* for the rotational shaft 35 of the developing sleeve 13 is stopped at a stop position of the associated guide member (not shown). Thus, the developing sleeve 13 is abutted with a predetermined pressure that is uniform along the longitudinal direction of the photosensitive drum 5, whereby the developing operation described earlier is carried out.

As described above, in the image forming apparatus 50 according to this embodiment, even though the developing device 8 is disposed below the optical path of the image-exposure light L with which the exposing device 7 irradiates the surface of the photosensitive drum 5, as opposed to the conventional art that employs a process cartridge, the toner supplying container 30 is disposed in a space above the optical path of the image-exposure light L in order to allow a toner to be supplied to the developer container 14 of the developing device 8, achieving optimal efficiency. Accordingly, the image forming apparatus 50 allows a large amount of toner to be contained in spite of its small size, and the construction of the developing device 8 is not complex.

Furthermore, conventionally, when a developing sleeve of a developing device is abutted on a photosensitive drum by applying a pressure by an urging member, a pressure is applied from one of the longitudinal side surfaces of a developer container, or a pressure is applied from a region that is not in the direction of a straight line connecting the rotational centers of the developing sleeve and the photosensitive drum of the developing device. Thus, the pressure applied in the abutting region (developing region) between the developing sleeve and the photosensitive drum in the longitudinal direction thereof has tended to be non-uniform. Thus, due to the non-uniform abutting of the developing sleeve with the photosensitive drum at the abutting region (developing region) in the longitudinal direction, a possibility of variation in concentration has existed.

In contrast, according to this embodiment, by moving the cam 41, the developer-container guide stay 40 supporting the developer container 14 is linearly moved in the direction of the straight line connecting the rotational centers of the developing sleeve 13 and the photosensitive drum 5 along the longitudinal direction of the developing sleeve 13, and the ends of the developing sleeve 13 in the longitudinal direction thereof are positioned at predetermined positions. Thus, the developing sleeve 13 is abutted on the photosensitive drum 5 with a uniform pressure along the longitudinal direction thereof. Accordingly, developing operations are performed favorably without variation in concentration.

As described hereinabove, according to the embodiment described above, a transporting path of a recording medium is provided in a direction extending from a lower region to a higher region. Furthermore, in order to allow a toner to be supplied from a toner supplying container to a developing device, the toner is supplied using a gravitational force, and an optical path is provided substantially in a horizontal direction. Accordingly, an image forming apparatus can be implemented in a small size without employing a complex structure.

Furthermore, the amount of toner that can be contained is increased compared with the conventional art that employs a process cartridge.

Furthermore, since an urging member for urging a developing device toward an image bearing member urges a developer holding member in the direction of a straight line connecting the rotational centers of the developer holding member and the image bearing member so that the developer holding member is abutted on the image bearing member, the developer holding member is abutted on the image bearing member with a uniform pressure along the longitudinal direction thereof. Accordingly, developing operations are performed favorably without causing variation in concentration.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member;

exposing means for performing an image exposure on the image bearing member;

developing means for developing, with a toner, an electrostatic image formed on the image bearing member;

a toner supplying container for supplying the toner to the developing means;

a toner supplying opening disposed on the toner supplying container, for supplying the toner to the developing means;

a toner transporting screw disposed in the toner supplying container, for transporting the toner to the toner supplying opening;

transporting means for transporting, from a lower position to an upper position, a recording medium onto which a toner image is to be transferred from the image bearing member;

a transferring roller for transferring the toner image on the image bearing member to the recording medium, while forming a transferring nip with the image bearing member, and transporting the recording medium by nipping in the transferring nip, and a piling portion disposed, which is diagonally disposed with the downstream side in a direction of transportation of the recording medium being higher, for piling the recording medium transported by the transporting means, wherein an optical path extending from the exposing means to the image bearing member is substantially horizontal, wherein the developing means is disposed below the optical path and the toner supplying container is disposed above the optical path and below the piling portion, wherein, the toner transporting screw is disposed such that a rotational axis thereof is substantially parallel to the optical path and substantially perpendicular to a rotational axis of the image bearing member.

2. An image forming apparatus according to claim 1, wherein the toner image is transferred from the image bearing member onto the recording medium at a position substantially opposite to a position where the image bearing member undergoes the image exposure.

3. An image forming apparatus according to claim 1, further comprising:

a container for containing the recording medium; and a piling portion disposed above the toner supplying container and below an original-document reader, for piling the recording medium on which the toner image has been formed.

4. An image forming apparatus according to claim 1, the toner supplying container is connected to the developing means such that a path for supplying the toner from the toner supplying container to the developing means is formed substantially along a gravitational direction.

5. An image forming apparatus according to claim 4, the toner supplying container is disposed so as to overlap with the exposing means at least partially as viewed in the gravitational direction.

* * * * *